US005860064A

United States Patent [19]

Henton

[11] Patent Number: 5,860,064

[45] **Date of Patent: *Jan. 12, 1999**

[54] METHOD AND APPARATUS FOR AUTOMATIC GENERATION OF VOCAL EMOTION IN A SYNTHETIC TEXT-TO-SPEECH SYSTEM

[75] Inventor: Caroline G. Henton, Santa Cruz, Calif.

[73] Assignee: Apple Computer, Inc., Cupertino, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 805,893

[22] Filed: Feb. 24, 1997

Related U.S. Application Data

[63] Continuation of Ser. No. 62,363, May 13, 1993, abandoned.

[51] Int. Cl.[6] ..... G10L 5/00

[52] U.S. Cl. ..... 704/260; 704/266

[58] Field of Search ..... 395/2.09, 2.69, 395/2.79, 2.67; 704/260, 259, 270, 200, 266, 272, 276

[56] References Cited

U.S. PATENT DOCUMENTS

| | | | |
|---|---|---|---|
| 3,704,345 | 11/1972 | Coker | 395/2.69 |
| 4,337,375 | 6/1982 | Freeman | 395/2.69 |
| 4,397,635 | 8/1983 | Samuels | 434/178 |
| 4,406,626 | 9/1983 | Anderson et al. | 395/2.69 |
| 4,779,209 | 10/1988 | Stapleford et al. | 395/2.69 |
| 5,151,998 | 9/1992 | Capps | 395/800 |
| 5,278,943 | 1/1994 | Gasper et al. | 395/2 |
| 5,396,577 | 3/1995 | Okawa et al. | 395/2.69 |

OTHER PUBLICATIONS

Prediction and Conversational Momentum in an Augmentalive Communication System Communications of the ACM, vol. 35, No. 5 May 1992.

*Primary Examiner*—Richemond Dorvil
*Attorney, Agent, or Firm*—Carr & Ferrell LLP

[57] ABSTRACT

A method and apparatus for the automatic application of vocal emotion parameters to text in a text-to-speech system. Predefining vocal parameters for various vocal emotions allows simple selection and application of vocal emotions to text to be output from a text-to-speech system. Further, the present invention is capable of generating vocal emotion with the limited prosodic controls available in a concatenative synthesizer.

28 Claims, 5 Drawing Sheets

METHOD AND APPARATUS FOR AUTOMATIC GENERATION OF VOCAL EMOTION IN A SYNTHETIC TEXT-TO-SPEECH SYSTEM

This application is a continuation of application Ser. No. 08/062,363, filed May 13, 1993, now abandoned.

CROSS-REFERENCE TO RELATED APPLICATIONS

This application is related to co-pending patent application Ser. No. 08/061,608 entitled "GRAPHICAL USER INTERFACE FOR SPECIFICATION OF VOCAL EMOTION IN A SYNTHETIC TEXT-TO-SPEECH SYSTEM" having the same inventive entity, assigned to the assignee of the present application, and filed with the United States Patent and Trademark Office on the same day as the present application.

FIELD OF THE INVENTION

The present invention relates generally to the field of sound manipulation, and more particularly to graphical interfaces for user specification of sound attributes in synthetic text-to-speech systems. Still further, the present invention relates to the parameters which are specified and/or altered by user interaction with the graphical interface. More particularly, the present invention relates to providing vocal emotion sound qualities to synthetic speech through user interaction with a graphical interface editor to specify such vocal emotion.

BACKGROUND OF THE INVENTION

For a considerable time in the history of speech synthesis, the speech produced has been mostly 'neutral' in tone, or in the worst case, monotone, i.e., it has sounded disinterested, or deficient, in vocal emotionality. This is why the synthesized intonation produced by prior art systems frequently sounded robotic, wooden and otherwise unnatural. Furthermore, synthetic speech research has been directed primarily towards maximizing intelligibility rather than including naturalness or variety. Recent investigations into techniques for adding emotional affect to synthesized speech have produced mixed results, and have concentrated on parametric synthesizers which generate speech through mathematical manipulations rather than on concatenative systems which combine segments of stored natural speech.

Text-to-speech systems usually incorporate rules for the application of intonational attributes for the text submitted for synthetic output. However, these rule systems generate generally neutral tones and, further, are not well suited for authoring or editing emotional prose at a high level. The problem lies not only in the terminology, for example "baseline-pitch", but also in the difficulty of quantifying these terms. If given the task of entering a stage play into a synthetic speech environment, it would be unbearable (or, at the very least, highly challenging for the layperson) to have to choose numerical values for the various speech parameters in order to incorporate vocal emotion into each word spoken.

For example, prior art speech synthesizers have provided for the customization of the prosody or intonation of synthetic speech, generally using either high-level or low-level controls. The high-level controls generally include text mark-up symbols, such as a pause indicator or pitch modifier. An example of prior art high-level text mark-up phonetic controls is taken from the Digital Equipment Corporation DECtalk DTC03 (a commercial text-to-speech system) Owner's Manual where the input text string:

It's a mad mad mad mad world.

can have its prosody customized as follows:

It's a [/]mad [\]mad [/]mad [\]mad [/\]world.

where [/] indicates pitch rise, and [\] indicates pitch fall.

Some prior art synthesizers also provide the user with direct control over the output duration and pitch of phonetic symbols. These are the low-level controls. Again, examples from DECtalk:

[ow<1000>]

causes the sound [ow] (as in "over") to receive a duration specification of 1000 milliseconds (ms); while

[ow<,90>]

causes [ow] to receive its default duration, but it will achieve a pitch value of 90 Hertz (Hz) at the end; while

[ow<1000,90>]

causes [ow] to be 1000 ms long, and to be 90 Hz at the end.

So, on the one hand, the disadvantage of the high-level controls is that they give only a very approximate effect and lack intuitiveness or direct connection between the control specification and the resulting or desired vocal emotion of the synthetic speech. Further, it may be impossible to achieve the desired intonational or vocal emotion effect with such a coarse control mechanism.

And on the other hand, the disadvantage of the low-level controls is that even the intonational or vocal emotion specification for a single utterance can take many hours of expert analysis and testing (trial and error), including measuring and entering detailed Hertz and milliseconds specifications by hand. Further, this is clearly not a task an average user can tackle without considerable knowledge and training in the various speech parameters available.

What is needed, therefore, is an intuitive graphical interface for specification and modification of vocal emotion of synthetic speech. Of course, other graphical interfaces for modification of sound currently exist. For example, commercial products such as SoundEdit®, by Farallon Computing, Inc., provide for manipulation of raw sound waveforms. However, SoundEdit® does not provide for direct user manipulation of the waveform (instead, the portion of the waveform to be modified is selected and then a menu selection is made for the particular modification desired).

Further, manipulation of raw waveforms does not provide a clear intuitive means to specify vocal emotion in the synthetic speech because of the lack of clear connection between the displayed waveform and the desired vocal emotion. Simply put, by looking at a waveform of human speech, a user cannot easily ascertain how it (or modifications to it) will sound when played through a loudspeaker, particularly if the user is attempting to provide some sort of vocal emotion to the speech.

By contrast, the present invention is completely intuitive. The present invention provides for authoring, direct manipulation and visual representation of emotional synthetic speech in a simplified format with a high level of abstraction. A user can easily predict how the text authored with the graphical editor of the present invention will sound because of the power of the explicit and intuitive visual representation of vocal parameters.

Further, the present invention provides for the automatic specification of prosodic controls which create vocal emotional affect in synthetic speech produced with a concatenative speech synthesizer.

First of all, it is important to understand that speech has two main components: verbal (the words themselves), and vocal (intonation and voice quality). The importance of vocal components in speech may be indicated by the fact that children can understand emotions in speech before they can understand words. Intonation is effected by changes in the pitch, duration and amplitude of speech segments. Voice quality (e.g. nasal, breathy, or hoarse) is intrasegmental, depending on the individual vocal tract. Note that a glossary has been included as Appendix A for further clarification of some of the terms used herein.

Along a sliding scale of 'affect', voices may be heard to contain personalities, moods, and emotions. Personality has been defined as the characteristic emotional tone of a person over time. A mood may be considered a maintained attitude; whereas an emotion is a more sudden and more subtle response to a particular stimulus, lasting for seconds or minutes. The personality of a voice may therefore be regarded as its largest effect, and an emotion its smallest. The term 'vocal emotion' will be used herein to encompass the full range of 'affect' in a voice.

The full range of attributes may be created in synthesized speech. Voice parameters affected by emotion are the pitch envelope (a combination of the speaking fundamental frequency, the pitch range, the shape and timing of the pitch contour), overall speech rate, utterance timing (duration of segments and pauses), voice quality, and intensity (loudness).

If computer memory and processing speed were unlimited, one method for creating vocal emotions would be to simply store words spoken in varying emotional ways by a human being. In the present state of the art, this approach is impractical. Rather than being stored, emotions have to synthesized on-line and in real-time. In parametric synthesizers (of which DECtalk is the most well-known and most successful), there may be as many as thirty basic acoustic controls available for altering pitch, duration and voice quality. These include e.g., separate control of formants' values and bandwidths; pitch movements on, and duration of, individual segments; breathiness; smoothness; richness; assertiveness; etc. Precision of articulation of individual segments (e.g., fully released stops, degree of vowel reduction), which is controllable in DECtalk, can also contribute to the perception of emotions such as tenderness and irony. These parameters may be manipulated to create voice personalities; DECtalk is supplied with nine different 'Voices' or personalities. It should be noted that intensity (volume) is not controllable within an utterance in DECtalk.

With a concatenative speech synthesizer, the type used in the preferred embodiment of the present invention, the range of acoustic controls is severely limited. Firstly, it is not possible to alter the voice quality of the speaker, since the speech is created from the recording of only one live speaker (who has their individual voice quality) speaking in one (neutral) vocal mode, and parameters for manipulating positions of the vocal folds are not possible in this type of synthesizer. Secondly, precision of articulation of individual segments is not controllable with concatenative synthesizers. It is nonetheless possible with the speech synthesizer used in the preferred embodiment of the present invention to control the parameters listed below:

TABLe 1

| Parameter | Speech Synthesizer Commands |
|---|---|
| 1. Average speaking pitch | Baseline Pitch (pbas) |
| 2. Pitch range | Pitch Modulation (pmod) |
| 3. Speech rate | Speaking rate (rate) |
| 4. Volume | Volume (volm) |
| 5. Silence | Silence (slnc) |
| 6. Pitch movements | Pitch rise (/), pitch fall (\) |
| 7. Duration | Lengthen (>), shorten (<) |

Although there are seven parameters listed in the table above, the present invention claims that for concatenative synthesizers, it is possible to produce a wide range of emotional affect using the interplay of only five parameters—since Speech rate and Duration, and Pitch range and Pitch movements are, respectively, effected by the same acoustic controls. In other words, the present invention is capable of providing an automatic application of vocal emotion to synthetic speech through the interplay of only the first five elements listed in the table above.

Further, the present invention is not concerned with the details of how emotions are perceived in speech (since this is known to be idiosyncratic and varies among users), but rather with the optimal means of producing synthesized emotions from a restricted number of parameters, while still maintaining optimal quality in the visual interface and synthetic speech domains.

SUMMARY AND OBJECTS OF THE INVENTION

It is an object of the present invention to provide a synthetic speech utterance with a more natural intonation.

It is a further object of the present invention to provide a synthetic speech utterance with one or more desired vocal emotions.

It is a still further object of the present invention to provide a synthetic speech utterance with one or more desired vocal emotions by the mere selection of the one or more desired vocal emotions.

The foregoing and other advantages are provided by a method for automatic application of vocal emotion to text to be output by a text-to-speech system, said automatic vocal emotion application method comprising: i) selecting a portion of said text; ii) selecting a vocal emotion to be applied to said selected text; iii) obtaining vocal emotion parameters associated with said selected vocal emotion; and iv) applying said obtained vocal emotion parameters to said selected text to be output by said text-to-speech system.

The foregoing and other advantages are also provided by an apparatus for automatic application of vocal emotion parameters to text to be output by a text-to-speech system, said automatic vocal emotion application apparatus comprising: i) a display device for displaying said text; ii) an input device for user selection of said text and for user selection of a vocal emotion to be applied to said selected text; iii) memory for holding said vocal emotion parameters associated with said selected vocal emotion; and iv) logic circuitry for obtaining said vocal emotion parameters associated with said selected vocal emotion from said memory and for applying said obtained vocal emotion parameters to said selected text to be output by said text-to-speech system.

Other objects, features and advantages of the present invention will be apparent from the accompanying drawings and from the detailed description which follows.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF THE INVENTION

Figure 1:
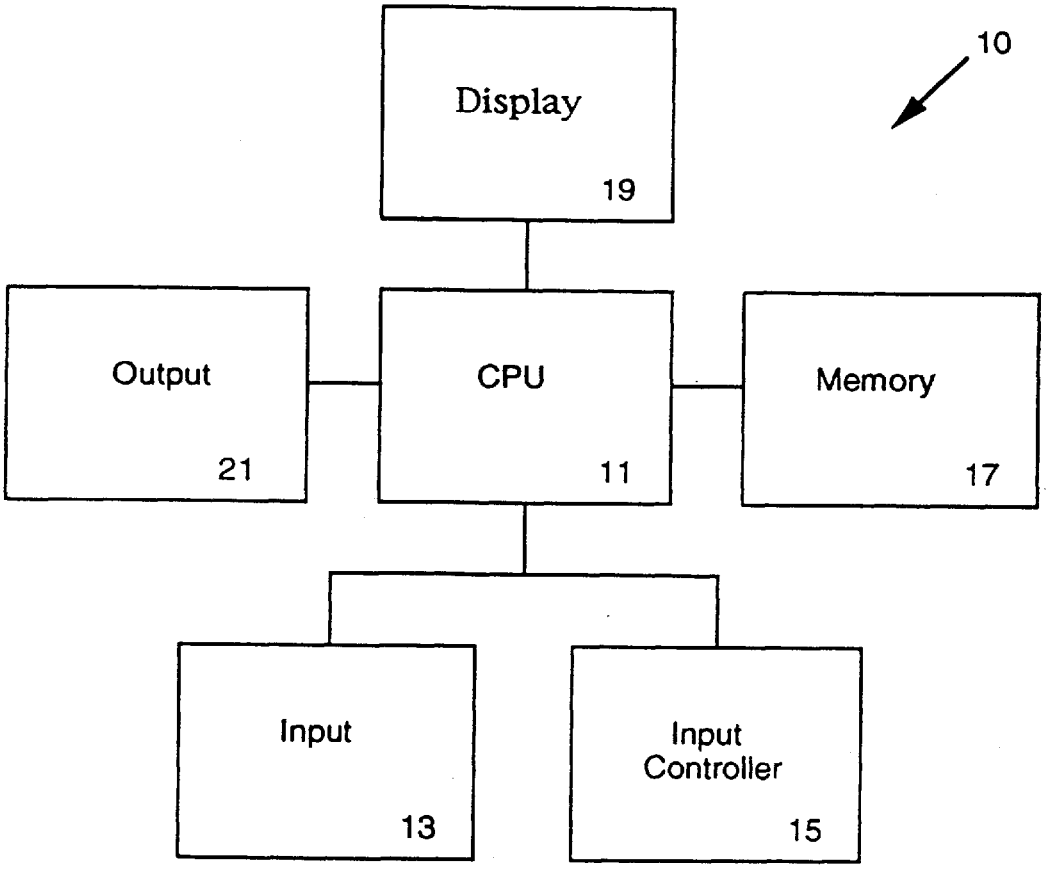
FIG. 1 is a block diagram of a computer system which might utilize the present invention.

FIG. 1 is a generalized block diagram of an appropriate computer system 10 which might utilize the present invention and includes a CPU/memory unit 11 that generally comprises a microprocessor, related logic circuitry, and memory circuitry. A keyboard 13, or other textual input device such as a write-on tablet or touch screen, provides input to the CPU/memory unit 11, as does input controller 15 which by way of example can be a mouse, a 2-D trackball, a joystick, etc. External storage 17, which can include fixed disk drives, floppy disk drives, memory cards, etc., is used for mass storage of programs and data. Display output is provided by display 19, which by way of example can be a video display or a liquid crystal display. Note that for some configurations of computer system 10, input device 13 and display 19 may be one and the same, e.g., display 19 may also be a tablet which can be pressed or written on for input purposes.

Figure 2:
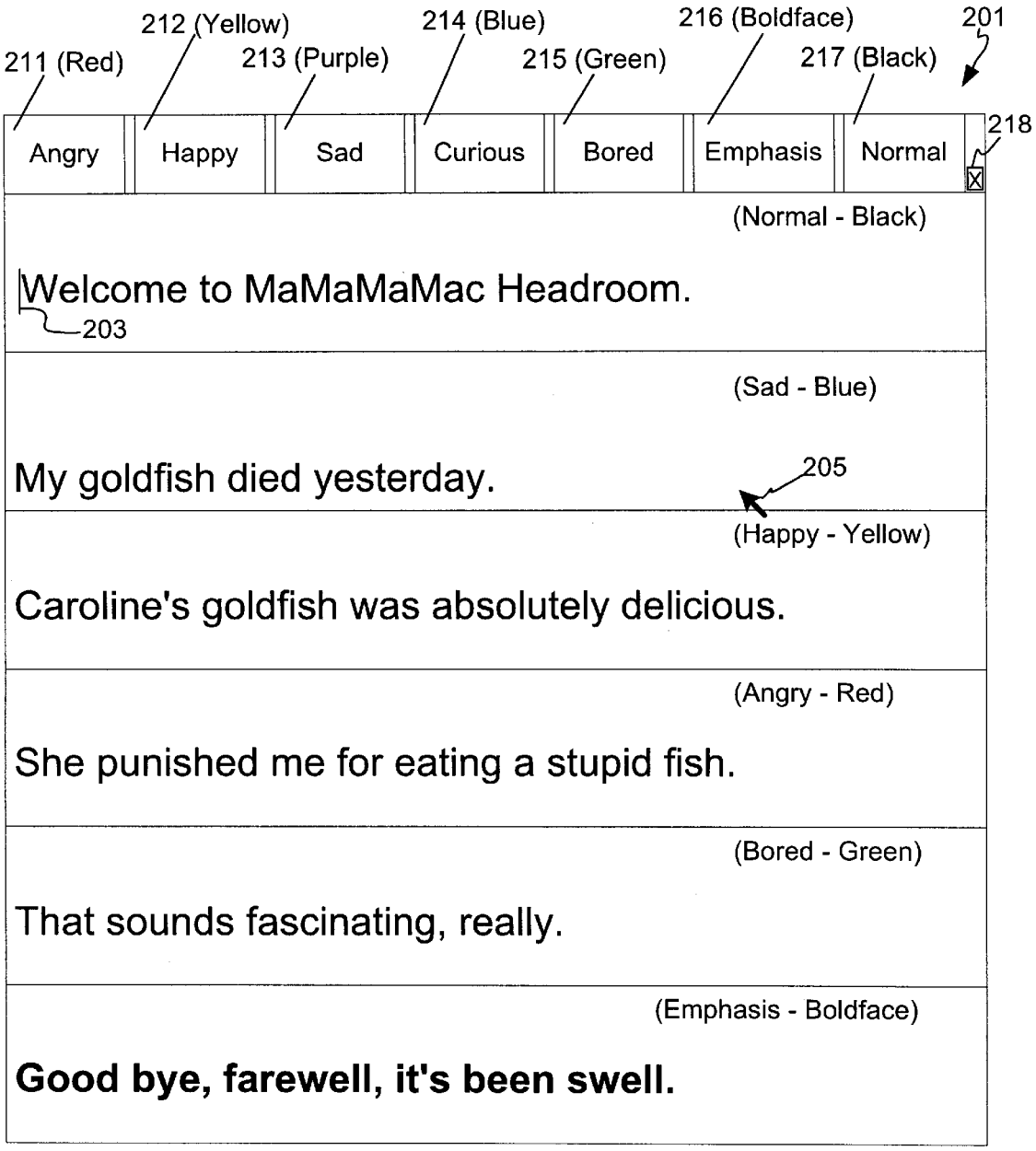
FIG. 2 is a screen display of the graphical user interface editor of the present invention.

Referring now to FIG. 2, the preferred embodiment of the graphical user interface editor 201 of the present invention can be seen (note that the emotion/color/font style indications in parenthesis are not shown in the screen display of the present invention and are only included in FIG. 2 for purposes of clarity of the present invention). Editor 201, shown residing within a window running on an Apple Macintosh computer in the preferred embodiment, provides the user with the capability to interactively manipulate text in such a way as to intuitively alter the vocal emotion of the synthetic speech generated from the text.

As will be explained more fully herein, graphical editor 201 provides for user modification of the volume and duration of speech synthesized text. As will also be explained more fully herein, graphical editor 201 also provides for user modification of the vocal emotion of speech synthesized text via selection buttons 211 through 217 (note that the emotion/color/font style indications in parenthesis are not shown in the screen display of the present invention and are only included in FIG. 2 for purposes of clarity of the present invention). User interaction is further provided by selection pointer 205, manipulable via input controller 15 of FIG. 1, and insertion point cursor 203.

Text Selection

In the preferred embodiment of the present invention, the user selects a word of text by manipulating input controller 15 so that pointer 205 is placed on or alongside the desired word and then initiating the necessary selection operation, e.g., depressing a button on the mouse in the preferred embodiment. Note that letters, words, phrases, sentences, etc., are all selectable in a similar fashion, by manipulating pointer 205 during the selection operation, as is well known in the art and commonly referred to as 'clicking and dragging' or 'double clicking'. Similarly, other well known text selection mechanisms, such as keyboard control of cursor 203, are equally applicable to the present invention.

Volume and Duration

Once a portion of text has been selected, the volume and duration of the resulting speech output can be modified by the user. In the preferred embodiment of the present invention, when a portion of text has been selected a box surrounding the selected portion of text is displayed. Note that other well known text selection display indicating mechanisms, such as reverse video, background highlighting, etc., are equally applicable to the present invention. In the preferred embodiment of the present invention, this surrounding selection box further includes three types of sizing grips or handles which can be utilized to modify the volume and duration of the selected portion of text.

Figure 3:
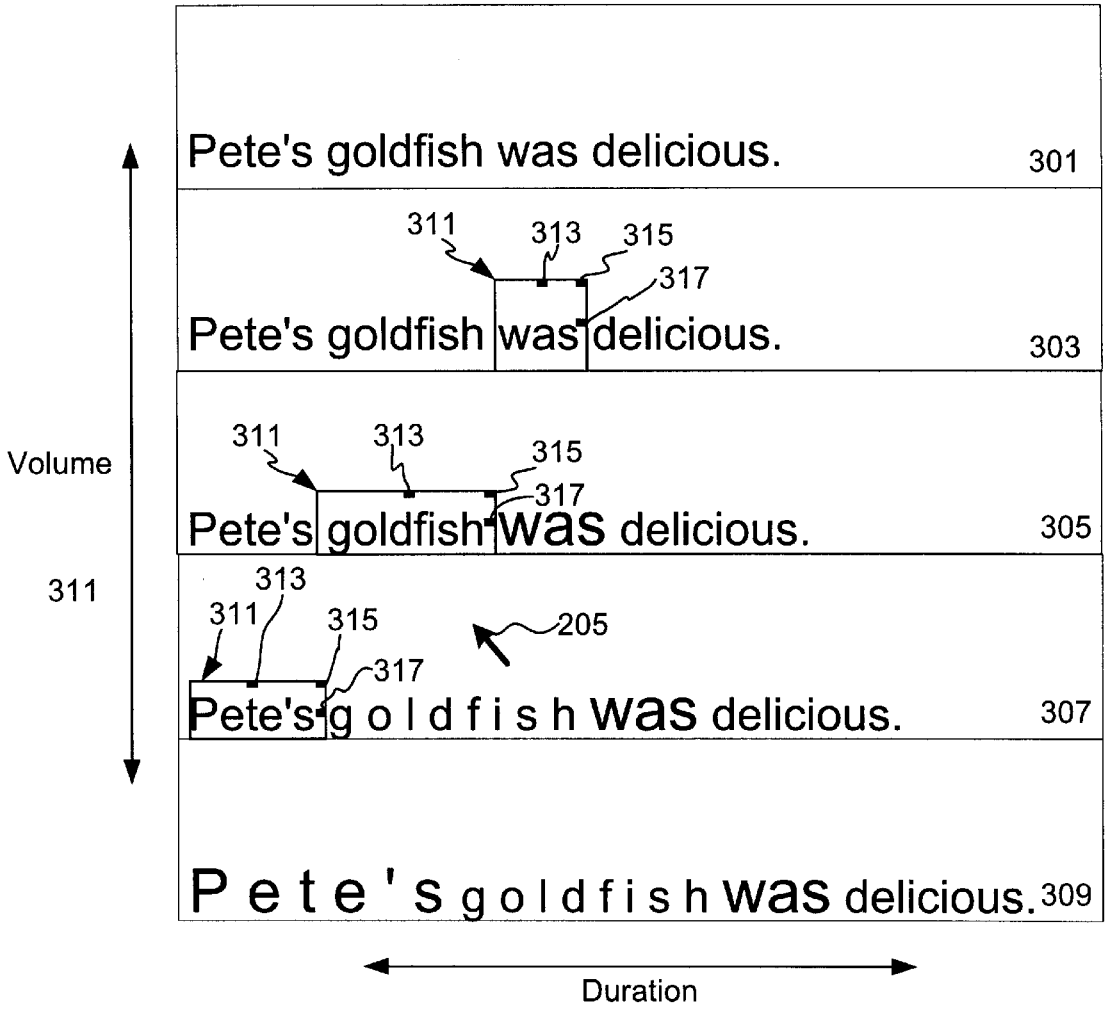
FIG. 3 is a screen display of the graphical user interface editor of the present invention depicting an example of volume and duration text-to-speech modification.

Referring now to FIG. 3, the textual portion of the graphical editor 201 of FIG. 2 can be seen (with different textual examples than in the earlier figure). FIG. 3 depicts a series of selections and modifications of a sample sentence using the graphical editor of the present invention. Throughout this example, note the surrounding selection box 311 which is displayed whenever a portion of text is selected. Further, note the sizing grips or handles 313 through 317 on the surrounding selection box 311.

As was stated above, whenever a portion of text is selected, that portion becomes surrounded by a selection box 311 having handles 313 through 317. In the preferred embodiment of the present invention, manipulation of handle 313 affects the volume of the selected portion of text while manipulation of handle 317 affects the duration (for how long the text-to-speech system will play that portion of text) of the selected portion of text. In the preferred embodiment of the present invention, manipulation of handle 315 affects both the volume and duration of the selected portion of text.

By way of further explanation, manipulating handles 313–317 of surrounding selection box 311 provides an intuitive graphical metaphor for the desired result of the synthetic speech generated from the selected text. Manipulating handle 313 either raises or lowers the height of the selected portion of text and thereby alters the resulting synthetic text-to-speech system volume of that portion of text upon output through a loudspeaker. Similarly, manipulating handle 317 either lengthens or shortens the selected portion of text and thereby alters the resulting synthetic text-to-speech system duration of that portion of text upon output through a loudspeaker. Further, manipulating handle 315 affects both volume and duration by simultaneously affecting both the height and length of the selected portion of text.

Reviewing the example of FIG. 3, the first sentence 301, which states "Pete's goldfish was delicious." (intended to represent a comment by Pete's cat, of course), is shown in its original unaltered default or Normal condition (and is therefore displayed in black, as will be explained more fully below). In the second sentence 303 the same sentence as sentence 301 is shown after the word "was" has been selected and modified. By way of explanation of the manipulation of volume and duration of synthetic speech generated from a text string, sample text string 303 comprising the sentence "Pete's goldfish was delicious." has had the word "was" selected according to the method described above. Again, once a portion of text has been selected, manipulation handles 313–317 are displayed on surrounding selection box 311. In this example, and according to the method described above, the resulting synthetic text-to-speech system output volume of the word "was" has been increased by manipulating volume handle 313 in an upward direction via pointer 205 and input controller 15. This increased volume is evident by comparing the height of the word "was" in text example 303 (before modification) to text example 305 (after modification). The word "was" in text example 305 is taller than the word "was" in text example 303 and will therefore be output at a louder volume by the synthetic text-to-speech system.

As a further example of the present invention, the word "goldfish" has been selected in text example 305, as is evident by selection box 311 and handles 313–317. In this example, and according to the method described above, the resulting synthetic text-to-speech system output duration of the word "goldfish" has been increased by manipulating duration handle 317 in a rightward direction via pointer 205 and input controller 15. This increased duration is evident by comparing the length of the word "goldfish" in text example 305 (before modification) to text example 307 (after modification). The word "goldfish" in text example 307 is longer than the word "goldfish" in text example 305 and will therefore be output for a longer duration by the synthetic text-to-speech system.

As a still further example of the graphical interface editor of the present invention, the word "Pete's" has been selected in text example 307, as is evident by selection box 311 and handles 313–317. In this example, and according to the method described above, the resulting synthetic text-to-speech system output volume and duration of the word "Pete's" has been increased by manipulating volume/duration handle 315 in a diagonally upward and rightward direction via pointer 205 and input controller 15. This increased volume and duration is evident by comparing the height and length of the word "Pete's" in text example 307 (before modification) to text example 309 (after modification). The word "Pete's" in text example 309 is taller and longer than the word "Pete's" in text example 307 and will therefore be output at a louder volume and for a longer duration by the synthetic text-to-speech system.

Thus, in the graphical interface editor of the present invention, the control of text volume and duration, as output from the text-to-speech system, takes advantage of the two natural intuitive spatial axes of a computer display: volume the vertical axis; duration the horizontal axis.

Further, note button 218 of FIG. 2. If a user desires to return a portion of text to its default size (volume and duration) settings, once that portion has again been selected, rather than requiring the user to manipulate any of the handles 313–317, the user need merely select button 218, again via pointer 205 and input controller 15 of FIG. 1, which automatically returns the selected text to its default size and volume/duration settings.

Emotion

Once a portion of text has been selected (again, according to the methods explained above as well as other well known methods), the vocal emotion of that selected text can be modified by the user. Again, in the preferred embodiment of the present invention, when a portion of text has been selected a selection box surrounding the selected portion of text is displayed.

Figure 4:
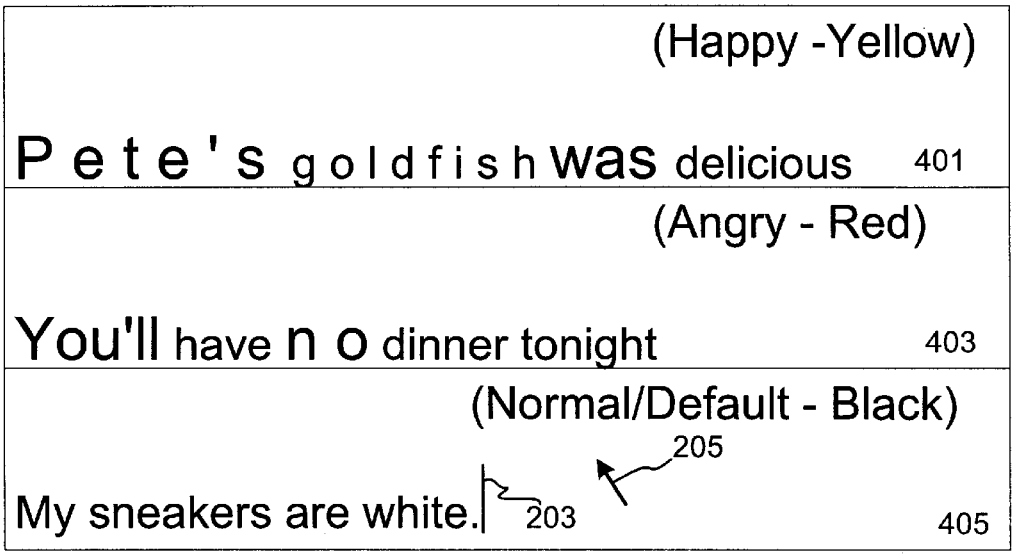
FIG. 4 is a screen display of the graphical user interface editor of the present invention depicting an example of vocal emotion text-to-speech modification.

Referring now to FIG. 4 (note that the emotion/color/font style indications in parentheses are not shown in the screen display of the present invention and are only included in the figure for purposes of clarity of the present invention), as with the examples of FIG. 3, only the textual portion of the graphical editor 201 of FIG. 2 can be seen (with further textual examples than the earlier figures). By comparison to text example 309 of FIG. 3, the first sentence 401 of FIG. 4 is shown after the text has been selected and an emotion ('Happy' in this example) has been selected or specified. In the preferred embodiment of the present invention, when a portion of text has been selected, referring again to the graphical interface editor 201 of FIG. 2, an emotional state or intonation can be chosen via pointer 205, input controller 15, and emotion selection buttons 211–217. As such, referring back to FIG. 4, sentence 401 can be specified as 'Happy' via selection button 212 of FIG. 2. Conversely, after the text has been selected, sentence 403 of FIG. 4 comprising "You'll have no dinner tonight." (intended to be Pete's response to his cat) can likewise be specified as 'Angry' via selection button 211 of FIG. 2. Note also the variations in volume and duration (evident by the variations in text height and length of the sentence) previously specified according to the methods described above.

In the preferred embodiment of the present invention, when a portion of text is specified as having a certain emotional quality, the specified text is displayed in a color intended to convey that emotion to the user of the text-to-speech or graphical interface editor system. For example, in the preferred embodiment of the present invention, sentence 401 of FIG. 4 was specified as 'Happy', via emotion selection button 212, and is therefore displayed in yellow (not shown in the figure—but indicated within the parentheses) while sentence 402 was specified as 'Angry', via emotion selection button 212, and is therefore displayed in red (also not shown in the figure—but indicated within the parenthesis).

By comparison, sentence 403 is specified according to the default emotion of 'Normal' and is therefore displayed in black (not shown in the figure—but indicated within the parentheses). Note that although the emotion of 'Normal' is the default emotion (meaning that 'Normal' is the default emotional specification given all text until some other emotion is specified), selection of the 'Normal' emotion selection button 217 is useful whenever a portion of text has previously received a different emotional specification and the user now desires to return that portion to a normal or neutral emotional characterization.

Note that the present invention is not limited to the particular vocal emotions indicated by emotion selection buttons 211–217 of FIG. 2. Other vocal emotions, either in place of or in addition to those shown in FIG. 2 are equally applicable to the present invention. Selection of other vocal emotions in place of or in addition to those of FIG. 2 would be a simple modification by the system implementor and/or the user to the graphical user editor interface of the present invention.

Note further that the particular colors/font styles indicating vocal emotional states of the preferred embodiment are user alterable such that if a particular user preferred to have pink indicate 'Happy', for example, this would be a simple modification (by the system implementor and/or by the user) to the graphical interface editor (which would then alter any displayed text having a vocal emotion of 'Happy' specified). This customization capability provides for personal preferences of different users and also provides for differences in cultural interpretations of various colors. Further, note that some vocal emotions are particularly amenable to textual display indicia rather than, or in addition to, color representation. For example, the vocal emotion of 'Emphasis' (see emotion selection button 216 of FIG. 2) is particularly well-suited to textual display in boldface, rather than using a particular color to indicate that vocal emotion (also indicated within the parentheses in FIG. 2). Again, color choice and font style (e.g., italic, boldface, underline, etc.) are system implementor and/or user definable/selectable thus making the present invention more broadly applicable and user friendly.

Graphical User Interface to Speech Synthesizer Translation

The preferred manner in which this invention would be implemented is in the context of creating vocal emotions that may be associated with text that is to be read by a text-to-speech synthesizer. The user would be provided with a list or display, as was explained more fully above, of the controls available for the specification of vocal emotions. To explain more fully the preferred embodiment of the present invention, the following reviews the specifics of how speech synthesizer parameters are specified for the text receiving vocal emotion qualities.

The translation of graphical modifications to speech synthesizer volume and duration parameters is a straightforward application of linear scaling and offset. Visually, graphical modifications to the text (as was explained above with reference to FIG. 3) are displayed in a font at x % of normal size horizontally and y % of normal size vertically. An allowable range of percentages is established, for example between 50 and 200 percent in the preferred embodiment of the present invention, which allows for sufficient dynamic range and manageable display. A corresponding range of volume settings and duration settings, as used by the speech synthesizer, are thereby established and a simple linear normalization is then performed in the preferred embodiment of the present invention in order to translate the graphical modifications to the resulting vocal emotion effect.

Figure 5:
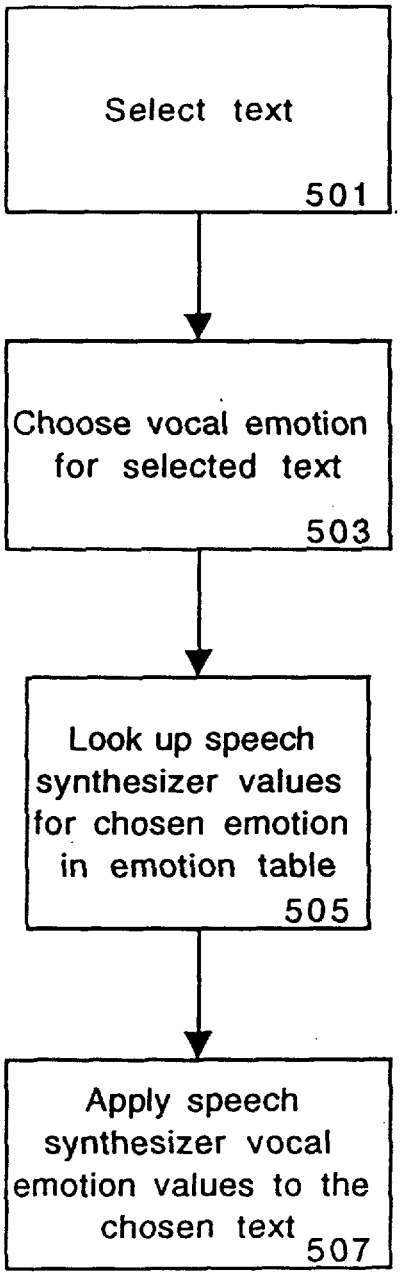
FIG. 5 is a flowchart of the graphical user interface editor to vocal emotion text-to-speech modification communication and translation of the present invention.

The translation of emotion is, by definition, more subjective yet still straightforward in the preferred embodiment of the present invention. Once the vocal emotion of the text has been specified, the translation between specification of vocal emotion color (or font style) and parameterization becomes a simple matter of a table look-up process. Referring now to FIG. 5, application of vocal emotion synthetic speech parameters according to the preferred embodiment of the present invention will now be explained. After a portion of text has been selected 501, and a particular vocal emotion has been chosen 503, the appropriate speech synthesizer values are obtained via look-up table 505, and thereby applied 507 by embedding the appropriate speech synthesizer commands in the selected text.

Table 2, below, gives examples of the defined emotions of the preferred embodiment of the present invention with their associated vocal emotion values. Note that these values are applicable to General American English although the present invention is applicable to other dialects and languages, albeit with different vocal emotion values specified. As such, note that the particular values shown are easily modifiable, by the system implementor and/or the user, to thus allow for differences in cultural interpretations and user/listener perceptions.

Note that the values (and underlying comments) in Table 2 are relative to the default neutral speech setting. And in particular, note that the values specified are for a female voice. When using the present invention for a male voice, the values in Table 2 would need to be altered. For example, in the preferred embodiment of the present invention, the default specification for a male voice would use a pitch mean of 43 and a pitch range of 8 (thus specifying a lower, but more dynamic, range than the female voice of 56; 6). However, in general, neither volume nor speaking rate is gender specific and as such these values would not need to be altered when changing the gender of the speaking voice. As for determining values for other vocal emotions when changing to a male speaking voice, these values would merely change as the female voice specifications did, again relative to the default specification. Lastly, note that the default speech rate is 175 words per minute (wpm) whereas a realistic human speaking rate range is 50–500 wpm.

TABLE 2

| Emotion | Pitch Mean/Range (pbas)/(pmod) | Volume (volm) | Speaking Rate (rate) |
|---|---|---|---|
| Default (normal) | 56;6 (neutral and narrow) | 0.5 (neutral) | 175 neutral |
| Angryl (threat) | 35;18 (low and narrow) | 0.3 (low) | 125 (slow) |
| Angry2 (frustration) | 80; 28 (high and wide) | 0.7 (high) | 230 (fast) |
| Happy | 65;30 (neutral and wide) | 0.6 (neutral) | 185 (medium) |
| Curious | 48; 18 (neutral and narrow) | 0.8 (high) | 220 (fast) |
| Sad | 40;18 (low and narrow) | 0.2 (low) | 130 (slow) |
| Emphasis | 55;2 (neutral and narrow) | 0.8 (high) | 120 (slow) |
| Bored | 45;8 (neutral and narrow) | 0.35 (low) | 195 (medium) |
| Aggressive | 50; 9 (neutral and narrow) | 0.75 (high) | 275 (fast) |
| Tired | 30;25 (low and neutral) | 0.35 (low) | 130 (slow) |
| Disinterested | 55;5 (neutral) | 0.5 (neutral) | 170 (neutral) |

The values shown in Table 2 are input to the speech synthesizer used in the preferred embodiment of the present invention. This speech synthesizer uses these values according to the command set and calculations shown in Appendix B herein. Note that the parameters pitch mean and pitch range are represented acoustically in a logarithmic scale with the speech synthesizer used with the present invention. The logarithmic values are converted to linear integers in the range 0–100 for the convenience of the user. On this scale, a change of +12 units corresponds to a doubling in frequency, while a change of −12 units corresponds to a halving in frequency.

Note that because pitch mean and pitch range are each represented on a logarithmic scale, the interaction between them is sensitive. On this basis, a pmod value of 6 will produce a markedly different perceptual result with a pbas value of 26 than with 56.

The range for volume, on the other hand, is linear and therefore doubling of a volume value results in a doubling of the output volume from the speech synthesizer used with the present invention.

In the preferred embodiment of the present invention, prosodic commands for Baseline Pitch (pbas), Pitch Modulation (pmod), Speaking Rate (rate), Volume (volm), and Silence (slnc), may be applied at all levels of text, i.e., passage, sentence, phrase, word, phoneme, allophone.

The following example shows the result of applying different vocal emotions to different portions of text. The first scenario is the result of merely inputting the text into the text-to-speech system and using the default vocal emotion parameters. Note that the portions of text in italics indicate the car repairshop employee while the rest of the text indicates the car owner. Further, note that the portions in double brackets indicate the speech synthesizer parameters (still further, note that the portions of text in single brackets are merely comments added for clarification and are intended to indicate which vocal emotion has been selected and are not usually present in the preferred embodiment of the present invention):

1. [Default] [[pbas 56; pmod 6; rate 175; volm 0.5]] Is my car ready? Sorry, we're closing for the weekend. What? I was promised it would be done today. I want to know what you're going to do to provide me with transportation for the weekend!

With only the default prosodic values in place, a text-to-speech system could play this scenario through a loudspeaker, and it might sound robotic or wooden due to the lack of vocal emotion. Therefore, after the application of vocal emotion parameters according to the preferred embodiment of the present invention (either through use of the graphical user interface, direct textual insertion, or other automatic means of applying the defined vocal emotion parameters), the text would look like the following scenario:

2. [Default] [[pbas 56; pmod 6; rate 175; volm 0.5]] Is my car ready? [Disinterested] [[pbas 55; pmod 5; rate 170; volm 0.5]] Sorry, we're closing for the weekend. [Angry 1] [[pbas 35; pmod 18; rate 125; volm 0.3]] What? I was promised it would be done today. [Angry 2] [[pbas 80; pmod 28; rate 230; volm 0.7]] I want to know what you're going to do to provide me with transportation for the weekend!

This second scenario thus provides the speech synthesizer with speech parameters which will result in speech output through a loudspeaker having vocal emotion. Again, it is this vocal emotion in speech which makes the speech output sound more human-like and which provides the listener with much greater content than merely hearing the words spoken in a robotic emotionless manner.

In the foregoing specification, the invention has been described with reference to a specific exemplary embodiment and alternative embodiments thereof. It will, however, be evident that various modifications and changes may be made thereto without departing from the broader spirit and scope of the invention as set forth in the appended claims. The specifications and drawings are, accordingly, to be regarded in an illustrative rather than a restrictive sense.

Appendix A

GLOSSARY

Terms which are cross-referenced in the glossary appear in bold print.

Allophone: a context-dependent variant of a phoneme. For example, the [t] sound in "train" is different from the [t] sound in "stain". Both [t]s are allophones of the phoneme /t/. Allophones do not change the meaning of a word, the allophones of a phoneme are all very similar to one another, but they appear in different phonetic contexts.

Concatenative synthesis: generates speech by linking pre-recorded speech segments to build syllables, words, or phrases. The size of the pre-recorded segments may vary from diphones, to demi-syllables, to whole words.

Duration: the length of time that it takes to speak a speech unit (word, syllable, phoneme, allophone). See Length.

General American English: a variety of American English that has no strong regional accent, and is typified by Californian, or West Coast American English.

Intonation: the pattern of pitch changes which occur during a phrase or sentence. E.g., the statement "You are reading" and the question "You are reading?" will have different intonation patterns, or tunes.

Length: the duration of a sound or sequence of sounds, measured in milliseconds (ms). For example, the vowel in "cart" has greater intrinsic duration (it is intrinsically longer) than the vowel in "cat", when both words are spoken at the same speaking rate.

Phone: the phonetic term used for instantiations of real speech sounds, i.e., a concrete realizations of a phoneme.

Phoneme: any sound that can change the meaning of a word. A phoneme is an abstract unit that encompasses all the pronunciations of similar context-dependent variants (such as the t in cat or the t in train). A phonemic representation is commonly used to encode the transition from written letters to an intermediate level of representation that is then converted to the appropriate sound segments (allophones).

Pitch: the perceived property of a sound or sentence by which a listener can place it on a scale from high to low. Pitch is the perceptual correlate of the fundamental frequency, i.e., the rate of vibration of the vocal folds. Pitch movements are effected by falling, rising, and level contours. Exaggerated speech, for example, would contain many high falling pitch contours, and bored speech would contain many level and low-falling contours.

Pitch range: the variation around the average pitch, the area within which a speaker moves while speaking in intonational contours. Pitch range has a median, an upper, and a lower part.

Prosody: The rhythm, modulation, and stress patterns of speech. A collective term used for the variations that can occur in the suprasegmental elements of speech, together with the variations in the rate of speaking.

Rate: the speed at which speech is uttered, usually described on a scale from fast to slow, and which may be measured in words per minute. Allegro speech is fast and legato speech is slow. Speaking rate will contribute to the perception of the speech style.

Speaking fundamental frequency: the average (mean) pitch frequency used by a speaker. May be termed the 'baseline pitch'.

Speech style: the way in which an individual speaks. Individual styles may be clipped, slurred, soft, loud, legato, etc. Speech style will also be affected by the context in which the speech is uttered, e.g., more and less formal styles, and how the speaker feels about what they are saying, e.g., relaxed, angry or bored.

Stop consonant: any sound produced by a total closure in the vocal tract. There are six stop consonants in General American English, that appear initially in the words "pin, tin, kin, bin, din, gun."

Suprasegmental: a phonetic effect that is not linked to an individual speech sound such as a vowel or consonant, and which extends over an entire word, phrase or sentence. Rhythm, duration, intonation and stress are all suprasegmental elements of speech.

Vocal cords: the two folds of muscle, located in the larynx, that vibrate to form voiced sounds. When they are not vibrating, they may assume a range of positions, going from closed tightly together and forming a glottal stop, to fully open as in quiet breathing. Voiceless sounds are produced with the vocal cords apart. Other variations in pitch and in voice quality are produced by adjusting the tension and thickness of the vocal cords.

Voice quality: a speaker-dependent characteristic which gives a voice its particular identity and by which speakers are most quickly identified. Such factors as age, sex, regional background, stature, state of health, and the overall speaking situation will affect voice quality; e.g., an older smoker will have a creaky voice quality; speakers from New York City are thought to have more nasalized voice qualities than speakers from other regions; a nervous speaker may have a breathy and tremulous voice quality.

Volume: the overall amplitude or loudness at which speech is produced.

Appendix B

EMBEDDED SPEECH COMMANDS

This section describes how, in the preferred embodiment of the present invention, commands are inserted directly into the input text to control or modify the spoken output.

When processing input text data, speech synthesizers look for special sequences of characters called delimiters. These character sequences are usually defined to be unusual pairings of printable characters that would not normally appear in the text. When a begin command delimiter string is encountered in the text, the following characters are assumed to contain one or more commands. The synthesizer will attempt to parse and process these commands until an end command delimiter string is encountered.

Embedded Speech Command Syntax

In the preferred embodiment of the present invention, the begin command and end command delimiters are defined to be [[and]]. The syntax of embedded command blocks is given below, according to these rules:

Items enclosed in angle brackets (<and>) represent logical units that are either defined further below or are atomic units that are self-explanatory.

Items enclosed in brackets are optional.

Items followed by an ellipsis ( . . . ) may be repeated one or more times.

For items separated by a vertical bar (|), any one of the listed items may be used.

Multiple space characters between tokens may be used if desired.

Multiple commands should be separated by semicolons.

All other characters that are not enclosed between angle brackets must be entered literally. There is no limit to the number of commands that can be included in a single command block.

Here is the embedded command syntax structure:

| Identifier | Syntax |
|---|---|
| CommandBlock | <BeginDelimiter> <CommandList> <EndDelimiter> |

-continued

| | |
|---|---|
| BeginDelimiter | <String1> \| <String2> |
| EndDelimiter | <String1> \| <String2> |
| CommandList | <Command> [ <Command>]. . . |
| Command | <CommandSelector> [Parameter]. . . |
| CommandSelector | <OSType> |
| Parameter | <OSType> \| <Stringl> \| <String2> \| <StringN> \| <FixedPointValue> \| <32BitValue> \| <16BitValue> \| <8BitValue> |
| String1 | <Quotechar> <Character> <QuoteChar> |
| String2 | <QuoteChar> <Character> <Character> <QuoteChar> |
| StringN | <QuoteChar> [<Character>]. . . <QuoteChar> |
| QuoteChar | "\|' |
| OSType | <4 character pattern (e.g., RATE, vers, aBcD)> |
| Character | <Any printable character (example A, b, *, #, x)> |
| FixedPointValue | <Decimal number: 0.0000 <= N <= 65535.9999> |
| 32BitValue | <OSType> \| <LongInt> \| <HexLongInt> |
| 16BitValue | <Integer> \| <HexInteger> |
| 8BitValue | <Byte> \| <HexByte> |
| LongInt | <Decimal number: 0 <= N <= 4294967295> |
| HexLongInt | <Hex number: 0x00000000 <= N <= 0xFFFFFFFF> |
| Integer | <Decimal number: 0 <= N <= 65535> |
| HexInteger | <Hex number: 0x0000 <= N <= 0xFFFF> |
| Byte | <Decimal number: 0 <= N <= 255> |
| HexByte | <Hex number: 0x00 <= N <= 0xFF> |

Embedded Speech Command Set

| Command | Selector | Command syntax and description |
|---|---|---|
| Version | vers | vers <Version><br>Version: := <32BitValue><br>This command informs the synthesizer of the format version that will be used in subsequent commands. This command is optional but is highly recommended. The current version is 1. |
| Delimiter | dlim | dlim <BeginDelimiter> <EndDelimiter><br>The delimiter command specifies the character sequences that mark the beginning and end of all subsequent commands. The new delimiters take effect at the end of the current command block. If the delimiter strings are empty, an error is generated. (Contrast this behavior with the dlim function of SetSpeechInfo.) |
| Comment | cmnt | cmnt [Character]. . .<br>This command enables a developer to insert a comment into a text stream for documentation purposes. Note that all characters following the cmnt selector up to the <EndDelimiter> are part of the comment. |
| Reset | rset | rset <32BitValue><br>The reset command will reset the speech channel's settings back to the default values. The parameter should be set to 0. |
| Baseline pitch | pbas | pbas [+\|−]<Pitch><br>Pitch ::= <FixedPointValue><br>The baseline pitch command changes the current pitch for the speech channel. The pitch value is a fixed-point number in the range 1.0 through 100.0 that conforms to the frequency relationship<br>Hertz = 440.0 * 2((Pitch − 69)/12)<br>If the pitch number is preceded by a + or − character, the baseline pitch is adjusted relative to its current value. Pitch values are always positive numbers. |
| Pitch modulation | pmod | pmod [+\|−]<ModulationDepth><br>ModulationDepth ::= <FixedPointValue><br>The pitch modulation command changes the modulation range for the |

-continued

| | | |
|---|---|---|
| | | speech channel. The modulation value is a fixed-point number in the range 0.0 through 100.0 that conforms to the following pitch and frequency relationships:<br>Maximum pitch = BasePitch + PitchMod<br>Minimum pitch = BasePitch − PitchMod<br>Maximum Hertz = BaseHertz * 2(+ ModValue/12)<br>Minimum Hertz = BaseHertz * 2(− ModValue/12)<br>A value of 0.0 corresponds to no modulation and will cause the speech channel to speak in a monotone. If the modulation depth number is preceded by a + or − character, the pitch modulation is adjusted relative to its current value. |
| Speaking rate | rate | rate [+\|−]<WordsPerMinute><br>WordsPerMinute<br>:: = <FixedPointValue><br>The speaking rate command sets the speaking rate in words per minute on the speech channel. If the rate value is preceded by a + or − character, the speaking rate is adjusted relative to its current value. |
| Volume | volm | volm [+\|−]<Volume><br>Volume ::= <FixedPointValue><br>The volume command changes the speaking volume on the speech channel. Volumes are expressed in fixed-point units ranging from 0.0 through 1.0. A value of 0.0 corresponds to silence, and a value of 1.0 corresponds to the maximum possible volume. Volume units lie on a scale that is linear with amplitude or voltage. A doubling of perceived loudness corresponds to a doubling of the volume. |
| Sync | sync | sync <SyncMessage><br>SyncMessage::= <32BitValue><br>The sync command causes a callback to the application's sync command callback routine. The callback is made when the audio corresponding to the next word begins to sound. The callback routine is passed the SyncMessage value from the command. If the callback routine has not been defined, the command is ignored. |
| Input mode | inpt | inpt TX \| TEXT \| PH \| PHON<br>This command switches the input processing mode to either normal text mode or raw phoneme mode. |
| Character mode | char | char NORM \| LTRL<br>The character mode command sets the word speaking mode of the speech synthesizer. When NORM mode is selected, the synthesizer attempts to automatically convert words into speech. This is the most basic function of the text-to-speech synthesizer. When LTRL mode is selected, the synthesizer speaks every word, number, and symbol letter by letter. Embedded command processing continues to function normally, however. |
| Number mode | nmbr | nmbr NORM \| LTRL<br>The number mode command sets the number speaking mode of the speech synthesizer. When NORM mode is selected, the synthesizer attempts to automatically speak numeric strings as intelligently as possible. When LTRL mode is selected, numeric strings are spoken digit by digit. |
| Silence | slnc | slnc <Milliseconds><br>Milliseconds ::= <32BitValue><br>The silence command causes the synthesizer to generate silence for the specified amount of time. |
| Emphasis | emph | emph +\|−<br>The emphasis command causes the next word to be spoken with either greater emphasis or less emphasis than would normally be used. Using + will force added emphasis, while using − will force reduced emphasis. |
| Synthesizer-Specific | xtnd | xtnd <SynthCreator> [parameter]<br>SynthCreator ::= <OSType><br>The extension command enables synthesizer-specific commands to be embedded in the input text stream. The format of the data following SynthCreator is entirely dependent on the synthesizer being used. If a particular SynthCreator is not recognized by the synthesizer, the command is ignored but no error is generated. |

What is claimed is:

1. A method for automatic application of vocal emotion to previously entered text to be outputted by a synthetic text-to-speech system, said method comprising:

selecting a portion of said previously entered text;

manipulating a visual appearance of the selected text to selectively choose a vocal emotion to be applied to said selected text;

obtaining vocal emotion parameters associated with said selected vocal emotion; and applying said obtained vocal emotion parameters to said selected text to be outputted by said synthetic text-to-speech system.

2. The method of claim 1 wherein said vocal emotion parameters comprise pitch mean, pitch range, volume and speaking rate.

3. The method of claim 2 wherein said text-to-speech system is a concatenative system.

4. The method of claim 3 wherein said vocal emotion is one of multiple vocal emotions available for selection.

5. The method of claim 4 wherein said multiple vocal emotions comprises anger, happiness, curiosity, sadness, boredom, aggressiveness, tiredness and disinterest.

6. A method for providing vocal emotion to previously entered text in a concatenative synthetic text-to-speech system, said method comprising:

selecting said previously entered text;

manipulating a visual appearance of the selected text to select a vocal emotion from a set of vocal emotions;

obtaining vocal emotion parameters predetermined to be associated with said selected vocal emotion, said vocal emotion parameters specifying pitch mean, pitch range, volume and speaking rate;

applying said obtained vocal emotion parameters to said selected text; and synthesizing speech from the selected text.

7. The method of claim 6 wherein said set of vocal emotions comprises anger, happiness, curiosity, sadness, boredom, aggressiveness, tiredness and disinterest.

8. An apparatus for automatic application of vocal emotion parameters to previously entered text to be outputted by a synthetic text-to-speech system, said apparatus comprising:

a display device for displaying said previously entered text;

an input device for permitting a user to selectively manipulate a visual appearance of the entered text and thereby select a vocal emotion;

memory for holding said vocal emotion parameters associated with said selected vocal emotion; and logic circuitry for obtaining said vocal emotion parameters associated with said selected vocal emotion from said memory and for applying said obtained vocal emotion parameters to the manipulated text to be outputted by said synthetic text-to-speech system.

9. The apparatus of claim 8 wherein said vocal emotion parameters comprise pitch mean, pitch range, volume and speaking rate.

10. The apparatus of claim 9 wherein said text-to-speech system is a concatenative system.

11. The apparatus of claim 10 wherein said vocal emotion is one of multiple vocal emotions available for selection.

12. The apparatus of claim 11 wherein said multiple vocal emotions comprises anger, happiness, curiosity, sadness, boredom, aggressiveness, tiredness and disinterest.

13. A method for converting text to speech that enables a user to interactively apply vocal parameters to user-selectable text, comprising the steps of:

selecting a portion of visually displayed text;

selectively manipulating the selected portion of text to modify a visual appearance of the selected portion of text and to modify certain vocal parameters associated with the selected portion of text; and applying the modified vocal parameters associated with the selected portion of text to synthesize speech from the modified text.

14. The method of claim 13 further comprising the step of, in response to manipulation, generating corresponding vocal parameter control data for transfer, in conjunction with said text, to an electronic text-to-speech synthesizer.

15. The method of claim 13 wherein said vocal parameters include a volume parameter, said control means include a volume handle and the step of responding includes, in response to said user vertically dragging said volume handle, the step of manipulating said volume parameter and modifying said selected portion of text to occupy a different amount of vertical space.

16. The method of claim 15 wherein said step of manipulating modifies a text-height display characteristic.

17. The method of claim 13 wherein the step of manipulation is performed by control means, said vocal parameters include a rate parameter, said control means include a rate handle and the step of responding includes, in response to said user horizontally dragging said rate handle, modifying said rate parameter and modifying said selected portion of text to occupy a different amount of horizontal space.

18. The method of claim 17 wherein said step of manipulating modifies a text-width display characteristic.

19. The method of claim 13 wherein said vocal parameters include a volume parameter and a rate parameter, said control means include a volume/rate handle and the step of manipulating includes, in response to said user vertically dragging said volume/rate handle, modifying said volume parameter and modifying said selected portion of text to occupy a different amount of vertical space, and, in response to said user horizontally dragging said volume/rate handle, modifying said rate parameter and modifying said selected portion of text to occupy a different amount of horizontal space.

20. The method of claim 13 wherein said vocal parameters include volume, rate and pitch, each of said vocal parameters has a predetermined base value, and a plurality of predetermined combinations of said vocal parameters each defines a respective emotion grouping.

21. The method of claim 20 wherein the step of manipulation is performed by control means, and said control means include a plurality of emotion controls which are each user activatable to select a corresponding one of said emotion groupings.

22. The method of claim 21 wherein said emotion controls include a plurality of differently colored emotion buttons each indicating a different emotion.

23. The method of claim 22 wherein said user selecting one of said emotion buttons selects one of said emotion groupings and correspondingly modifies a color characteristic of said selected portion of text.

24. The method of claim 13 wherein said vocal parameters are specified as a variance from a predetermined base value.

25. A computer-readable storage medium storing program code for causing a computer to perform the steps of:

permitting a user to select a portion of text;

permitting a user to manipulate the selected text with a plurality of user-manipulatable control means;

responding to each user-manipulation of one of said control means by modifying a plurality of corresponding vocal parameters of the selected text and modifying a displayed appearance of said portion of text; and synthesizing speech from the modified text.

26. A system for converting text to speech that enables a user to interactively apply vocal parameters to user-selectable text, comprising:

means for a user to select a portion of text;

a plurality of interactive user manipulatable means for controlling vocal parameters associated with the selected portion of text;

means, responsive to said control means, for modifying a plurality of vocal parameters associated with the portion of text and for modifying a displayed appearance of said portion of text; and means for synthesizing speech from the modified text.

27. A method of converting text to speech, comprising:

entering text;

displaying a portion of the entered text;

selecting a portion of the displayed text;

manipulating an appearance of the selected text to selectively change a set of vocal emotion parameters associated with the selected text; and synthesizing speech having a vocal emotion from the manipulated portion of text;

whereby the vocal emotion of the synthesized speech depends on the manner in which the appearance of the text is manipulated.

28. A method according to claim 27 wherein the step entering is followed immediately by the step of displaying.

* * * * *